US006500230B1

(12) United States Patent
Pescheux et al.

(10) Patent No.: US 6,500,230 B1
(45) Date of Patent: Dec. 31, 2002

(54) METHOD FOR PROTECTING A NON-FERROUS LIQUID METAL FROM OXIDATION

(75) Inventors: Michel Pescheux, Brie Conte (FR); Michel L. Rhodon, Tremblay (FR)

(73) Assignee: Brochot S.A. (FR)

( * ) Notice: Subject to any disclaimer, the term of this patent is extended or adjusted under 35 U.S.C. 154(b) by 0 days.

(21) Appl. No.: 09/622,779

(22) PCT Filed: Feb. 26, 1999

(86) PCT No.: PCT/FR99/00434

§ 371 (c)(1),
(2), (4) Date: Oct. 3, 2000

(87) PCT Pub. No.: WO99/43458

PCT Pub. Date: Sep. 2, 1999

(30) Foreign Application Priority Data

Feb. 26, 1998 (FR) ..... 98 02315

(51) Int. Cl.[7] ..... C22B 9/10

(52) U.S. Cl. ..... 75/594; 75/602; 75/709; 164/475

(58) Field of Search ..... 75/594, 602, 709; 164/475

(56) References Cited

U.S. PATENT DOCUMENTS 3,843,355 A 10/1974 Reding

FOREIGN PATENT DOCUMENTS

| | | | |
|---|---|---|---|
| EP | WO 97/21510 | 6/1997 | |
| FR | 2 047 250 | 3/1971 | |
| GB | 457826 | * 12/1936 | ..... 75/602 |

OTHER PUBLICATIONS

W. Buchen: "Oxidationsschutz Bei Aluminium—Und Magnesium . . . " Giesserei, vol. 77, No. 18, Sep. 3, 1990, pp. 581–585, XPOOO151201, Dusseldorf, DE see p. 583; tables 2, 3.

G. Schemm: "Schwefelhexafluorid Als Oxydationsschutz . . . " Giesserei, vol. 58, No. 19, Sep. 23, 1971, pp. 558–565, XP002085525, Dusseldorf, DE see p. 562; table 2.

Ernst Brunhuber: "Giesserei Lexikon" 1991, Schiele & Schon GMBH, Berlin, DE XP002085526, see p. 675, right–hand col., line 33—p. 676, left–hand col., line 25.

* cited by examiner

*Primary Examiner*—Melvyn Andrews
(74) *Attorney, Agent, or Firm*—Anthony J. Casella; Gerald E. Hespos

(57) ABSTRACT

The invention relates to a process for protecting a non-ferrous liquid metal from oxidation and from firing in a machine processing this metal or its alloys, consisting of disposing a gaseous mixture containing carbon dioxide at the surface of the non-ferrous metal. According to this process, the gaseous mixture is prepared by adding to the carbon dioxide an oxidising gas, argon and xenon only, this gaseous mixture having properties ensuring protection from the ambient atmosphere, and the proportion of carbon dioxide in this gaseous mixture ranging from 50% to 90% by volume.

8 Claims, 1 Drawing Sheet

METHOD FOR PROTECTING A NON-FERROUS LIQUID METAL FROM OXIDATION

BACKGROUND OF THE INVENTION

1. Field of the Invention

The invention relates to a process for protecting from oxidation and firing a non-ferrous liquid metal, in particular liquid magnesium, in a machine processing this metal or its alloys.

2. Description of the Related Art

It is known, in casting machines for manufacturing ingots of magnesium or its alloys, to protect the magnesium from the phenomena of oxidation and firing by injection at its surface inerting or inhibiting gaseous mixtures constituted by one or more gases such as carbon dioxide, air, nitrogen and argon, containing gases such as sulphur hexafluoride ($SF_6$), or other fluorine-containing compounds such as $BF_3$, $(CClF_2)_2$, or sulphur dioxide ($SO_2$). However, given the nature of the gases injected in this way, this manner of proceeding involves major risks to human health and to environment.

SUMMARY OF THE INVENTION

The object of the present invention is to overcome the aforementioned drawbacks and, for this purpose, it provides a process for protecting a non-ferrous liquid metal from oxidation and from firing in a machine processing this metal or its alloys, consisting in disposing a gaseous mixture containing carbon dioxide at the surface of the non-ferrous metal, and involving practically no risk to the health of the operators or to the environment, since it uses neither the aforementioned fluorine-containing compounds nor $SO_2$.

According to the present invention, the process is characterised in that the gaseous mixture is prepared by adding to the carbon dioxide an oxidising gas, argon and xenon only, this gaseous mixture having properties ensuring protection from the ambient atmosphere, and the proportion of carbon dioxide in this gaseous mixture ranging from 50% to 90% by volume.

Advantageously, the proportion by volume in the gaseous mixture of the oxidising gas ranges from 5% to 15%, that of the argon is at most 40% and that of the xenon is at most 10%

Advantageously, according to the invention, the components of the gaseous mixture are dried before they come into contact with the metal.

The respective roles of each of the four constituents of the gaseous mixture according to the invention are as follows:

- carbon dioxide ($CO_2$) is a heavy gas, and further has properties of adsorption on magnesium oxide (MgO), which reinforces the barrier effect of the latter;
- the oxidising gas makes it possible to obtain at the surface a layer of magnesium oxide that acts as a barrier;
- argon, which is a heavy, non-oxidising gas, and which is insensitive to magnesium radiation at high temperatures, ensures that the temperature rise of the gaseous mixture, and thus the convection phenomena associated therewith, are limited;
- xenon, which is a very heavy, inert gas, and which is also insensitive to magnesium radiation at high temperatures, gives the mixture a greater specific gravity.

It is the combination of the respective properties of these four components, and the interaction between them, that provides optimal protection for liquid metal, in particular for magnesium.

To ensure that the invention is clearly understood, a description will be given below, by way of a non-limitative example, of a preferred form of embodiment, with reference to the annexed drawing, the sole FIGURE of which is a partial schematic view of a magnesium ingot casting machine.

With reference to the drawing, there is shown a casting machine including a casting line 1 carrying a series of ingot moulds 2 continuously travelling past a casting tube 3 via which magnesium in a liquid state is deposited in ingot moulds 2.

BRIEF DESCRIPTION OF THE DRAWINGS

The FIGURE is a schematic illustration of the process of the subject invention.

DETAILED DESCRIPTION OF THE PREFERRED EMBODIMENT

Figure 1:
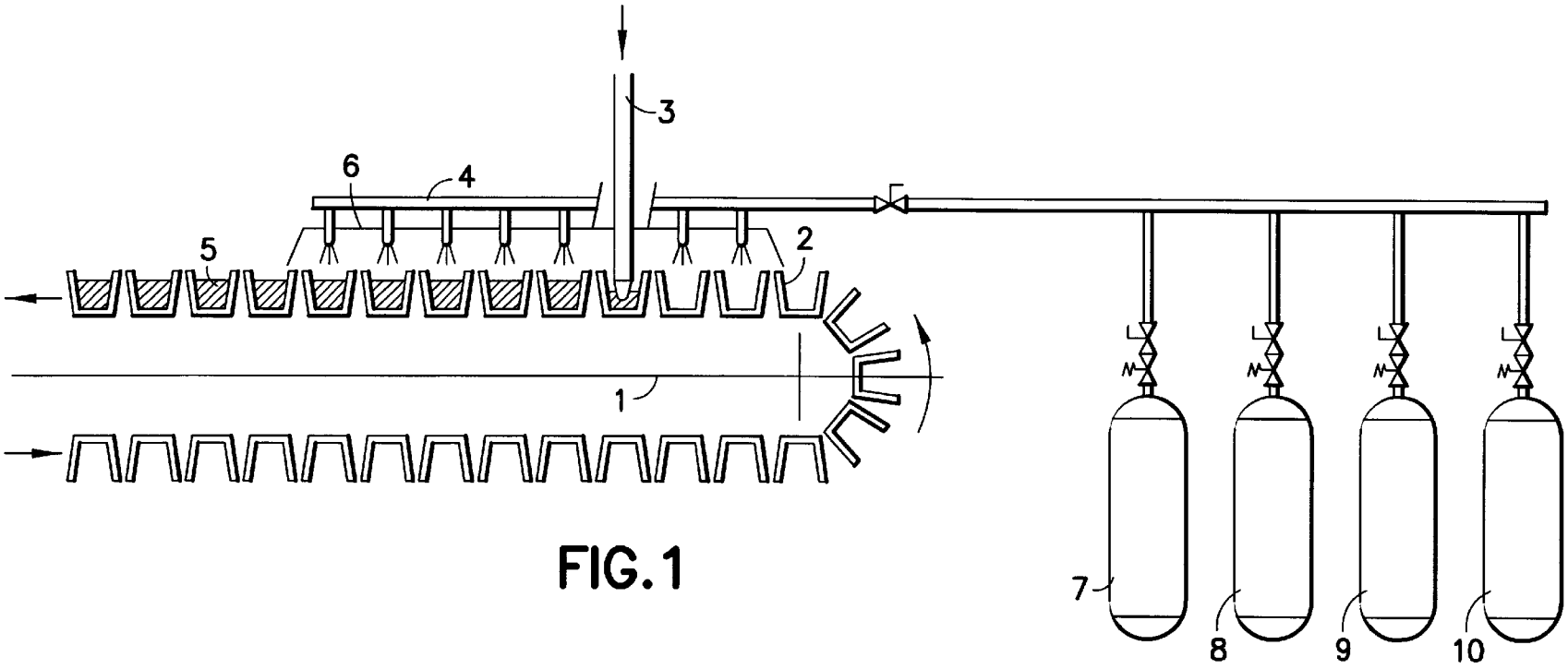

To protect the magnesium deposited in ingot moulds 2 from the ambient air, by preventing its oxidation and firing, a protective gaseous mixture is distributed via injection pipes 4 into ingot moulds 2 when empty prior to casting, and then at the surface of the metal in ingot moulds 2 when filled, to such an extent that the surface of ingot 5 is solidified and non longer runs any risk of oxidising.

To restrict gas consumption and to increase gas efficiency, the area of injection pipes 4 is generally covered by a confinement hood 6.

The protective gaseous mixture is prepared from a cylinder 7 containing carbon dioxide ($CO_2$), from a cylinder 8 containing dry air, from a cylinder 9 containing argon and from a cylinder 10 containing xenon. Pressurised cylinders 7 to 10 are associated in a known manner with a suitable pressure reducing and blending device.

In the particular example described, the gaseous mixture injected via pipes 4 includes the following proportions by volume: 70% carbon dioxide, 9% dry air, 20% argon and 1% xenon, and this gaseous mixture is found to ensure efficient protection, from oxidation and firing, of the liquid magnesium contained in ingot moulds 2.

It will be appreciated that the above description has been given simply by way of a non-limitative example, and that structural modifications or additions could be made thereto without departing from the scope of the present invention. It will be appreciated, in particular, that there has been described, by way of example, the application of the process according to the invention to a magnesium ingot casting machine, but that the metal processed could be another non-ferrous liquid metal, and that the machine in question could be another machine for processing this metal.

What is claimed is:

1. Process for protecting a non-ferrous liquid metal from oxidation and from firing in a machine processing this metal or its alloys, consisting of disposing a gaseous mixture containing carbon dioxide at the surface of the non-ferrous metal, characterised in that the gaseous mixture is prepared by adding to the carbon dioxide dry air, argon and xenon only to form a gaseous mixture consisting of carbon dioxide, dry air, xenon and argon, this gaseous mixture having properties ensuring protection from the ambient atmosphere, and the proportion of carbon dioxide in this gaseous mixture ranging from 50% to 90% by volume.

2. Process according to claim 1, characterised in that the proportion by volume of oxidizing gas ranges from 5% to 15%.

3. Process according to claim 2, characterised in that the proportion by volume of argon in the gaseous mixture is at most 40%.

4. Process according to claim 1, characterised in that the proportion by volume of the xenon in the gaseous mixture is at most 10%.

5. Process according to claim 1, characterised in that the components of the gaseous mixture are dried before they come into contact with the metal.

6. Process according to claim 1, characterised in that the metal protected is liquid magnesium.

7. Process according to claim 1, characterised in that the machine for processing the non-ferrous liquid metal is a casting machine.

8. Process according to claim 1, characterised in that the proportion of volume of argon in the gaseous mixture is at most 40%.

* * * * *